US008308308B2

(12) United States Patent
Kimura

(10) Patent No.: US 8,308,308 B2
(45) Date of Patent: Nov. 13, 2012

(54) DEVICE AND METHOD FOR DRIVING DISCHARGE LAMP, LIGHT SOURCE DEVICE, AND PROJECTOR THAT RECORDS AN OPERATION HISTORY OF APPLIED START-UP PULSES

(75) Inventor: Keishi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 307 days.

(21) Appl. No.: 12/706,251

(22) Filed: Feb. 16, 2010

(65) Prior Publication Data

US 2010/0208150 A1 Aug. 19, 2010

(30) Foreign Application Priority Data

Feb. 16, 2009 (JP) ..... 2009-032588

(51) Int. Cl.
*G05F 1/00* (2006.01)
*H05B 37/02* (2006.01)
*H05B 41/36* (2006.01)

(52) U.S. Cl. ..... 353/85; 315/307; 315/308

(58) Field of Classification Search ..... 353/85; 315/209 R, 219, 224, 246, 291, 307, 308
See application file for complete search history.

(56) References Cited

U.S. PATENT DOCUMENTS 6,185,047 B1 * 2/2001 Peterson et al. ..... 359/640
6,448,715 B1 * 9/2002 Fujiwara et al. ..... 315/129
2006/0033633 A1 * 2/2006 Jayaram et al. ..... 340/635
2009/0121640 A1 5/2009 Ootsuka et al.

FOREIGN PATENT DOCUMENTS

| | | | |
|---|---|---|---|
| GB | 2 417 148 | A | 2/2006 |
| JP | A-7-201471 | | 8/1995 |
| JP | A-11-242295 | | 9/1999 |
| JP | A-2001-257091 | | 9/2001 |
| JP | A-2004-296841 | | 10/2004 |
| JP | A-2008-21588 | | 1/2008 |
| JP | A-2008-77907 | | 4/2008 |
| WO | WO 01/45471 | A1 | 6/2001 |
| WO | WO 2005/109965 | A1 | 11/2005 |
| WO | WO 2007/029387 | A1 | 3/2007 |
| WO | WO 2008/061562 | A1 | 5/2008 |

OTHER PUBLICATIONS

Apr. 6, 2010 Search Report issued in European Patent Application No. 10153583.9.

* cited by examiner

*Primary Examiner* — Thanh Luu
*Assistant Examiner* — Renee Naphas
(74) *Attorney, Agent, or Firm* — Oliff & Berridge, PLC

(57) ABSTRACT

A lamp driving device that drives a discharge lamp, includes: a start-up circuit configured to apply a start-up pulse for starting an operation of the discharge lamp; a non-volatile memory configured to store data therein; and a history recording unit configured to record an operation history of the applying of the start-up pulse that is performed by the start-up circuit in the non-volatile memory.

16 Claims, 6 Drawing Sheets

DEVICE AND METHOD FOR DRIVING DISCHARGE LAMP, LIGHT SOURCE DEVICE, AND PROJECTOR THAT RECORDS AN OPERATION HISTORY OF APPLIED START-UP PULSES

BACKGROUND

1. Technical Field

The present invention relates to technology for driving a discharge lamp.

2. Related Art

As discharge lamps used as light sources in projectors (projection devices), high-intensity discharge lamps (HID lamp) such as a high-pressure mercury lamp, a metal halide lamp, and a high-pressure sodium lamp are widely known. Generally, the discharge lamp of a projector emits light by receiving the supply of an alternating current (AC) and generating discharge light caused by arc discharge generated between two electrodes.

A lamp driving device configured to drive the discharge lamp includes a start-up circuit (igniter) configured to apply a start-up pulse to the electrodes of the discharge lamp for starting the operation of the discharge lamp. Generally, the start-up pulse reaches a relatively high voltage of about 5 to 12 kilovolt (kV). In JP-A-2001-257091, a lamp driving device of a discharge lamp includes a start-up circuit applying a start-up pulse is described.

In a case where a start-up pulse is repeatedly generated in a lamp driving device, insulation of electric circuits configuring the lamp driving device slowly deteriorates. However, sufficient review on breakdown of a lamp driving device that is accompanied with deterioration of the insulation due to the start-up pulses has not been made. The breakdown of the lamp driving device accompanied by the deterioration of insulation can render the discharge lamp unable to be normally driven. Accordingly, the performance of the discharge lamp cannot be sufficiently realized.

SUMMARY

An advantage of some aspects of the invention is that it provides technology capable of managing the operating life of the lamp driving device configured to drive a discharge lamp.

The invention can be implemented in the following forms or applications.

Application 1

According to Application 1, there is provided a lamp driving device configured to drive a discharge lamp. The lamp driving device includes: a start-up circuit configured to apply a start-up pulse for starting an operation of the discharge lamp; a non-volatile memory configured to store data therein; and a history recording unit configured to record an operation history of the applying of the start-up pulse that is performed by the start-up circuit in the non-volatile memory. According to the lamp driving device of Application 1, the operating life of the lamp driving device can be managed based on the operation history that is stored in the non-volatile memory.

Application 2

The lamp driving device according to Application 1 may further include a start-up suppressing unit configured to suppress the applying of the start-up pulse that is performed by the start-up circuit based on the operation history recorded in the non-volatile memory. According to the lamp driving device of Application 2, the applying of the start-up pulse is suppressed based on the operation history stored in the non-volatile memory. Therefore, the driving of the discharge lamp by using the lamp driving device that has exceeded the assumed operating life can be prevented.

Application 3

The lamp driving device according to Application 2 may further include: a start-up control unit configured to perform a start-up control process of consecutively generating the start-up pulses by controlling the start-up circuit. In such a case, the history recording unit records the number of times start-up operations are performed that is the number of times of performing the start-up control process in the non-volatile memory as the operation history, and the start-up suppressing unit suppress the applying of the start-up pulse that is performed by the start-up circuit when the accumulated number of times, which is acquired by accumulating the number of times the start-up operation has been performed, recorded in the non-volatile memory exceeds a reference threshold value. According to the lamp driving device of Application 3, the number of times the start-up operation is performed in the start-up control process is stored in the non-volatile memory as the operation history. Accordingly, compared to a case where information on each generated start-up pulse is stored, the operation history can be managed in the non-volatile memory in a simpler manner.

Application 4

In the lamp driving device according to Application 2, it may be configured so the history recording unit records the number of times of generating pulses, which is the number of times start-up pulses are generated, in the non-volatile memory as the operation history, and the start-up suppressing unit suppresses the applying of the start-up pulse that is performed by the start-up circuit when the accumulated number of times, which is acquired by accumulating the number of times the pulse is generated, recorded in the non-volatile memory exceeds a reference threshold value. According to the lamp driving device of Application 4, the number of times the start-up pulse is generated which causes the deterioration of insulation is managed as the operation history, and accordingly, the deterioration state of insulation of the lamp driving device can be determined more accurately.

Application 5

In the lamp driving device according to any one of Applications 2 to 4, the start-up suppressing unit may suppress the applying of the start-up pulse that is performed by the start-up circuit based on the operation history recorded in the non-volatile memory before the start-up circuit performs the start-up process after turn on the lamp driving device. According to the lamp driving device of Application 5, generation of a start-up pulse by using the lamp driving device configured to exceed the assumed operating life can be avoided in advance.

Application 6

In the lamp driving device according to any one of Applications 1 to 5, the non-volatile memory may be an electronic component that is mounted on a printed board on which electronic components configuring the start-up circuit are mounted. According to the lamp driving device of Application 6, the operating life of the lamp driving device can be managed for each printed board that is influenced by the deterioration of insulation due to start-up pulses.

Application 7

The lamp driving device according to any one of Applications 1 to 6 may further include: an information output unit configured to output information on the basis of the operation history recorded in the non-volatile memory to the outside of the lamp driving device. According to the lamp driving device of Application 7, the operating life of the lamp driving device can be managed on the outside of the lamp driving device based on the operation history that is stored in the non-volatile memory.

Application 8

According to Application 8, there is provided a light source device configured to emitslight. The light source device includes: a discharge lamp configured to emit light by electric discharge between electrodes; a start-up circuit configured to apply a start-up pulse for starting the operation of the discharge lamp; a non-volatile memory configured to store data therein; and a history recording unit configured to record the operation history of the applying of the start-up pulse performed by the start-up circuit in the non-volatile memory. According to the light source device of Application 8, the light source device can be maintained and managed based on the operation history stored in the non-volatile memory.

Application 9

According to Application 9, there is provided a projector that projects a video. The projector includes: a discharge lamp configured to emit light by electric discharge between electrodes, as a light source of projection light representing the video; a start-up circuit configured to apply a start-up pulse for starting an operation of the discharge lamp; a non-volatile memory configured to store data therein; and a history recording unit configured to record operation history of the applying of the start-up pulse that is performed by the start-up circuit in the non-volatile memory. According to the projector of Application 9, the projector can be maintained and managed based on the operation history stored in the non-volatile memory.

Application 10

According to Application 10, there is provided a driving method for driving a discharge lamp by using a lamp driving device having a start-up circuit configured to apply a start-up pulse used for starting an operation of the discharge lamp, the method comprising step of recording the operation history of the applying of the start up pulse that is performed the start-up circuit by a computer included in the lamp driving device to a non-volatile memory. According to the driving method of Application 10, the operating life of the lamp driving device can be managed based on the operation history stored in the non-volatile memory.

The forms of the aspects of the invention are not limited to the lamp driving device, the light source device, the projector, and the driving method. Thus, the aspects of the invention can be applied to other forms such as a system having a projector and a program for implementing the function for driving the discharge lamp in a computer. The aspects of the invention is not limited at all to the above-described forms. Thus, it is apparent that the invention can be performed in various forms within the scope without departing from the basic concept of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

In order to clarify the configuration and the operation of an embodiment of the invention, hereinafter, a projector as a projection apparatus according to an embodiment of the invention will be described.

A. Embodiments

A-1. Configuration of Projector

Figure 1:
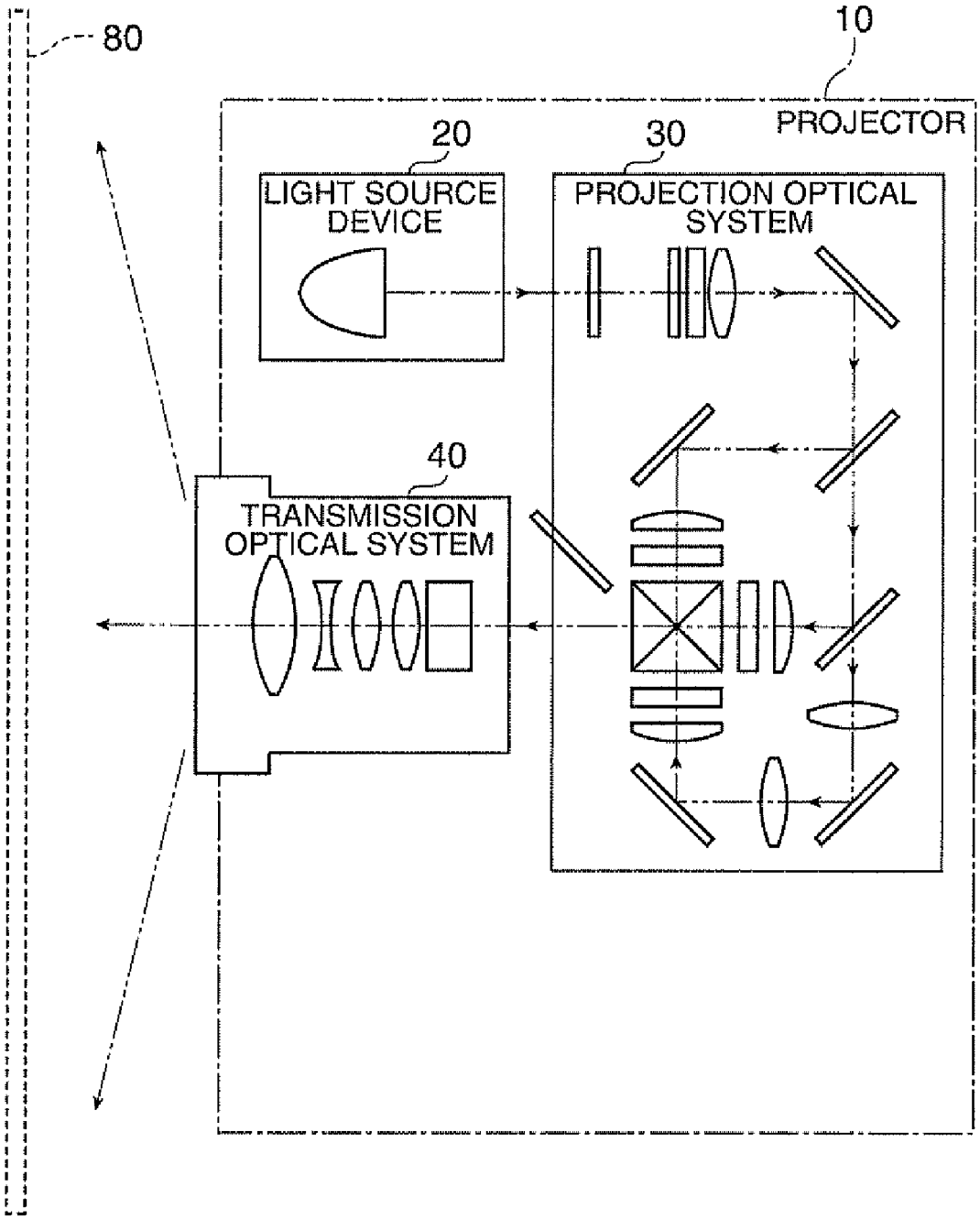
FIG. 1 is an explanatory diagram mainly showing the configuration of a projector.

FIG. 1 is an explanatory diagram mainly showing the configuration of a projector 10. The projector 10 projects a video onto a screen 80. The screen 80 is a planar surface on which a video is displayed. The screen 80 may be a projection screen or a wall surface.

The projector 10 includes a light source device 20, a projection optical system 30, and a transmission optical system 40. The light source device 20 of the projector 10 emits light as a light source, and the light emitted from the light source device 20 is supplied to the projection optical system 30. The light source device 20 will be described in detail later.

The projection optical system 30 of the projector 10 generates projection light representing a video by using the light supplied from the light source device 20. The projection light generated by the projection optical system 30 is transmitted to the transmission optical system 40. In this embodiment, the projection optical system 30 is a color separating and synthesizing optical system. The projection optical system 30 generates projection light by separating the light supplied from the light source device 20 into red light, green light, and blue light, respectively modulating the light by using three spatial optical modulators, and composing the light into one beam again. In this embodiment, the number of the spatial optical modulators is three. However, in another embodiment, the number of the spatial optical modulators may be less than three or more than three. In this embodiment, the spatial optical modulator is a transmissive-type liquid crystal panel configured to modulates transmitted light. However, in another embodiment, a reflective-type liquid crystal panel configured to modulate reflected light may be used, or a micromirror-type optical modulation device such as a Digital Micromirror Device (DMD (registered trademark)) may be used.

The transmission optical system 40 of the projector 10 transmits projected light that is generated by the projection optical system 30 onto the screen 80. In this embodiment, the transmission optical system 40 is a projection lens unit in which a plurality of lenses such as a front lens, a zoom lens, a master lens, and a focus lens are arranged. The transmission optical system 40 is not limited to the projection lens unit and may be an optical system configured to reflect the projection light generated by the projection optical system 30 by using at least one of an aspheric lens, a magnifying lens, a diffusion glass, an aspheric mirror, and a reflecting mirror onto the screen 80.

A2. Detailed Configuration of Light Source Device

Figure 2:
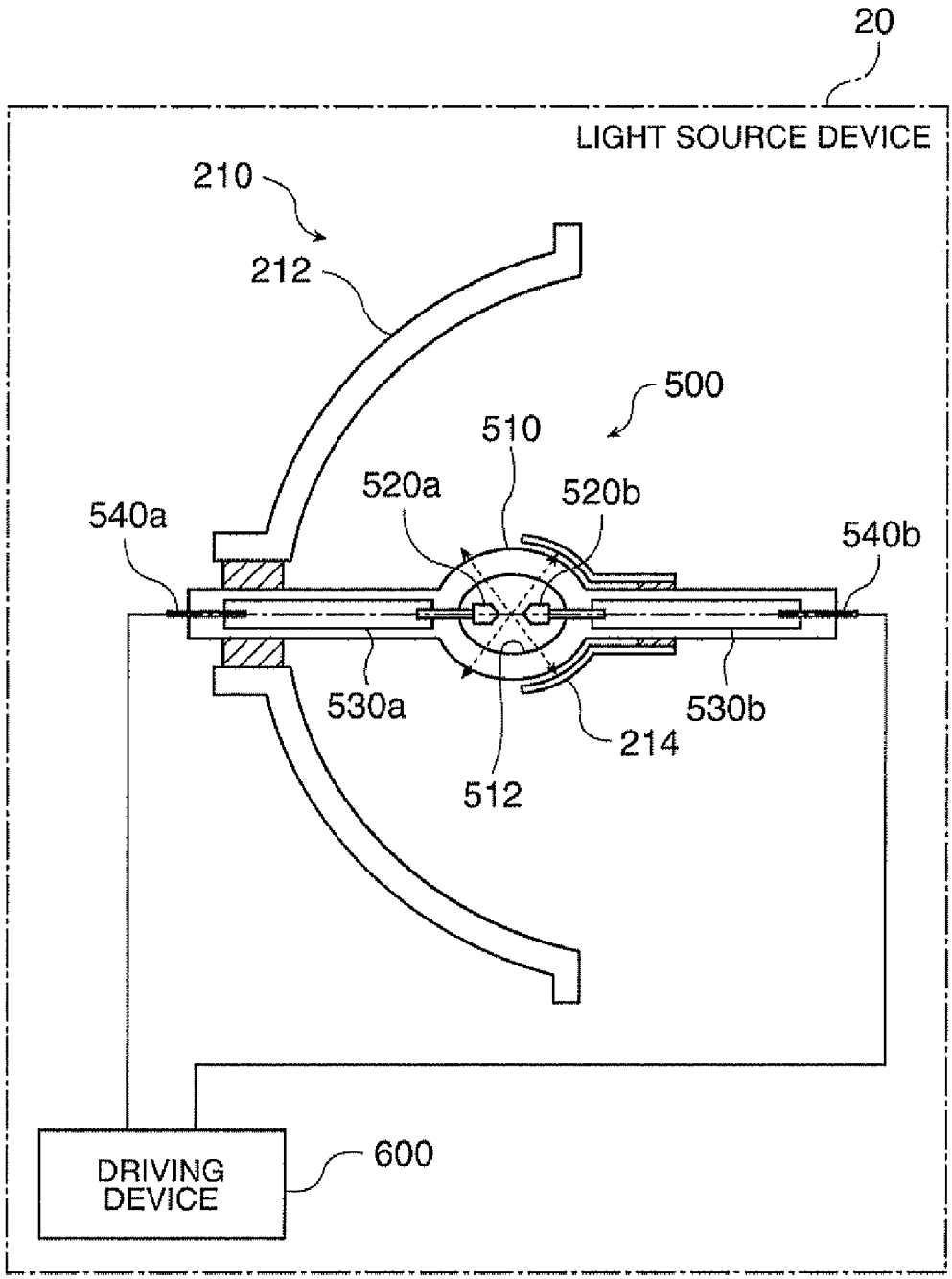
FIG. 2 is an explanatory diagram showing a detailed configuration of a light source device of a projector.

FIG. 2 is an explanatory diagram showing a detailed configuration of the light source device 20 of the projector 10.

The light source device 20 includes a light source unit 210 and a lamp driving device 600. The light source unit 210 of the light source device 20 includes a main reflecting mirror 212, a sub reflecting mirror 214, and a discharge lamp 500. The lamp driving device 600 of the light source device 20 drives the discharge lamp 500. The lamp driving device 600 will be described later in detail.

The discharge lamp 500 of the light source unit 210 includes a light emitting tube 510, electrodes 520*a* and 520*b*, conductive members 530*a* and 530*b*, and electrode terminals 540*a* and 540*b*. The discharge lamp 500 is driven by the lamp driving device 600 and emits light utilizing arc discharge generated between the electrode 520*b* serving as a first electrode and the electrode 520*a* serving as a second electrode.

The light emitting tube 510 of the discharge lamp 500 is a silica glass tube that has transparency and has a center portion expanded in a sphere shape. In the center portion of the light emitting tube 510, a discharge space portion 512 in which gas containing a discharge medium such as rare gas, mercury, or a metallic halogen compound is enclosed is formed.

The electrodes 520*a* and 520*b* of the discharge lamp 500 are disposed so as to be spaced apart from each other in the discharge space portion 512 of the light emitting tube 510 and generate arc discharge inside the discharge space portion 512 of the light emitting tube 510. In this embodiment, the electrodes 520*a* and 520*b* are formed from tungsten.

The conductive member 530*a* of the discharge lamp 500 is a conductive body that electrically connects the electrode 520*a* and the electrode terminal 540*a* to each other. In addition, the conductive member 530*b* of the discharge lamp 500 is a conductive body that electrically connects the electrode 520*b* and the electrode terminal 540*b* to each other. In this embodiment, the conductive members 530*a* and 530*b* are formed from molybdenum foil and are enclosed in the light emitting tube 510.

The electrode terminals 540*a* and 540*b* of the discharge lamp 500 are conductive bodies that introduce an alternating current that is supplied from the lamp driving device 600 to the electrodes 520*a* and 520*b* and are disposed on both end portions of the light emitting tube 510.

The main reflecting mirror 212 of the light source unit 210 has a reflective surface of a concave-face shape. The main reflecting mirror 212 is disposed on the end portion of the discharge lamp 500 that is located on the electrode 520*a* side. The main reflecting mirror 212 reflects discharge light that is generated from the discharge lamp 500 to the projection optical system 30 serving as a reflection target. In this embodiment, the reflective surface of the main reflecting mirror 212 has a spheroidal shape. However, in another embodiment, a paraboloid reflective surface may be used. In addition, in this embodiment, the main reflecting mirror 212 is made from silica glass. However, in another embodiment, the main reflecting mirror 212 may be made from crystallized glass.

The sub reflecting mirror 214 of the light source unit 210 has a reflective surface having a semispherical shape that is smaller than that of the main reflecting mirror 212. The sub reflecting mirror 214 is disposed on the electrode 520*b* side located in the center portion of the discharge lamp 500 in which the discharge space portion 512 is formed. The sub reflecting mirror 214 reflects discharge light, which is emitted to the electrode 520*b* side, out of the discharge light generated in the discharge lamp 500 to the main reflecting mirror 212. In this embodiment, the sub reflecting mirror 214 is formed from silica glass. However, in another embodiment, the sub reflecting mirror 214 may be formed from crystallized glass.

A3. Detailed Configuration of Lamp Driving Device

Figure 3:
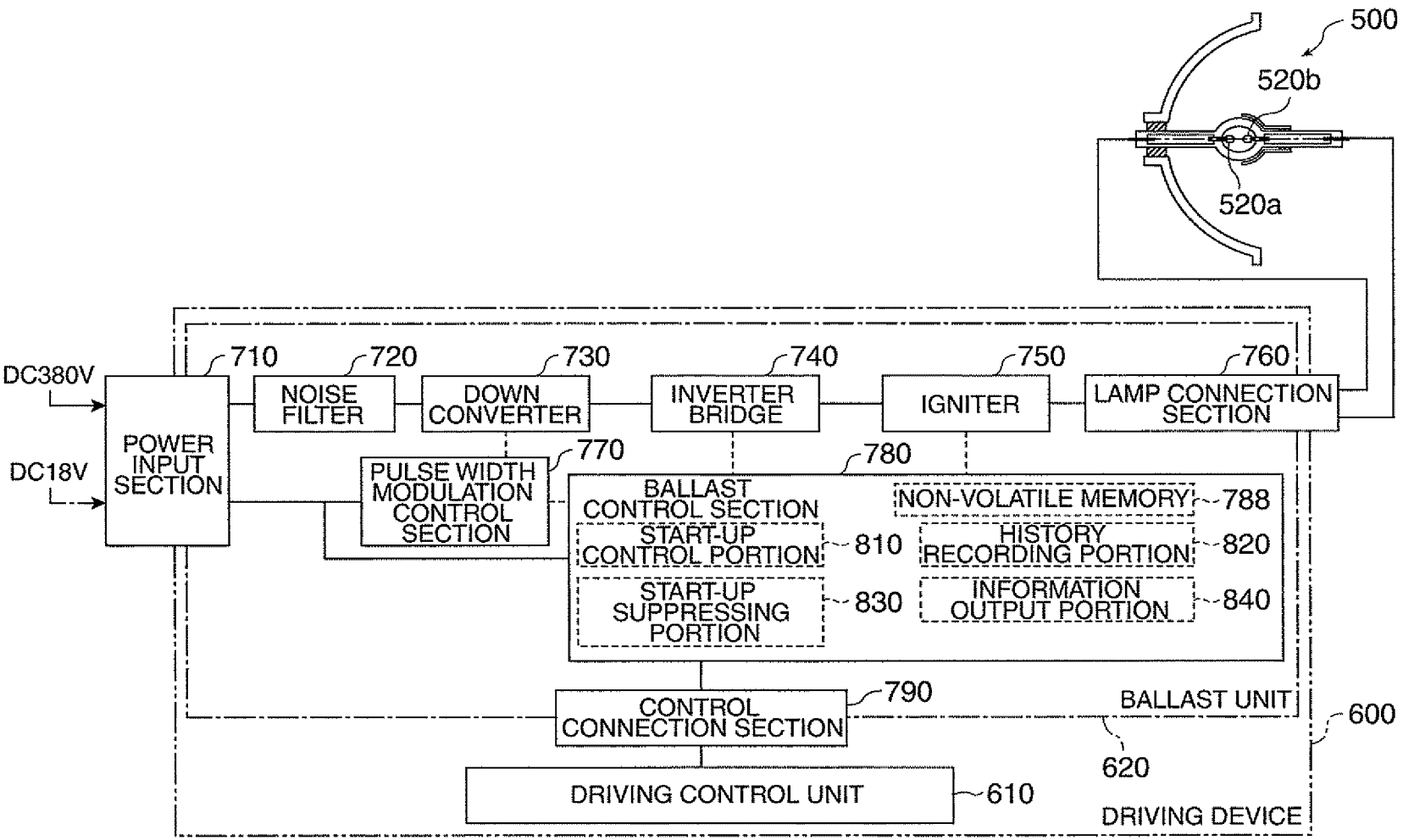
FIG. 3 is an explanatory diagram mainly showing a detailed configuration of a lamp driving device for a light source device.

FIG. 3 is an explanatory diagram mainly showing a detailed configuration of the lamp driving device 600 of the light source device 20. The lamp driving device 600 includes a driving control unit 610 and a ballast unit 620.

The driving control unit 610 of the lamp driving device 600 is an electric circuit configured to control the operation of the ballast unit 620. In this embodiment, the driving control unit 610 is a computer configured to include a CPU (Central Processing Unit), and various processes that are performed by the driving control unit 610 is implemented by the operation of the CPU that is performed based on a program. However, in another embodiment, the functions may be implemented by the operation of an electronic circuit of the driving control unit 610 that is performed based on the physical circuit configuration thereof.

The ballast unit 620 of the lamp driving device 600 is a stabilizer configured to start the discharge lamp 500 and maintains the lighted state of the discharge lamp 500. The ballast unit 620 includes a power input section 710, a noise filter 720, a down converter 730, an inverter bridge 740, an igniter 750, a lamp connection section 760, a pulse-width modulation control section 770, a ballast control section 780, and a control connection section 790.

Figure 4:
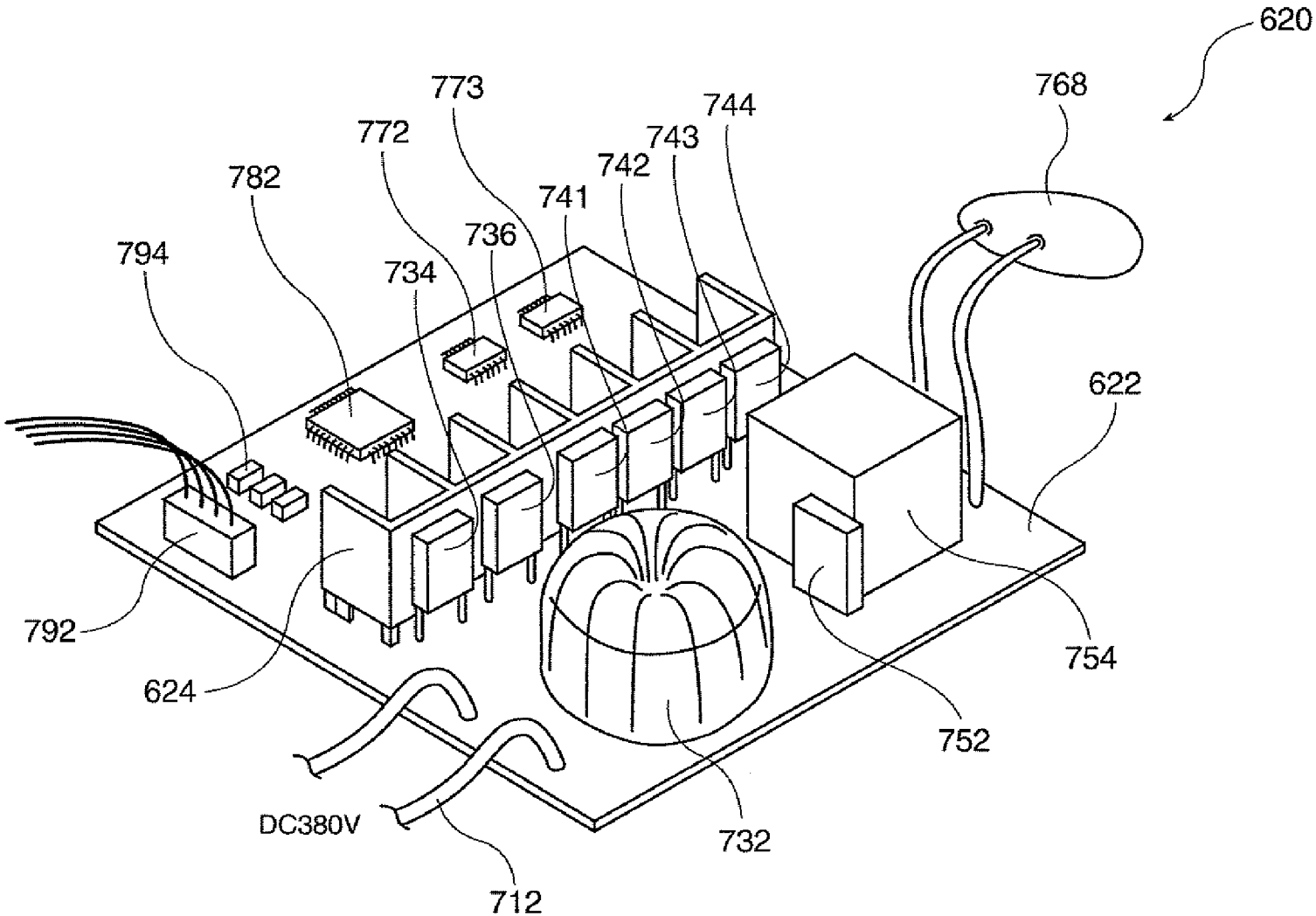
FIG. 4 is a perspective view showing an external configuration of a ballast unit.

FIG. 4 is a perspective view showing the external configuration of the ballast unit 620. The ballast unit 620 includes a printed board 622 on which various electronic components are mounted and a heat radiator 624 that radiates heat generated by the electronic components mounted on the printed board 622. The electronic components mounted on the printed board 622 of the ballast unit 620 includes a power cord 712, an inductor 732, a power MOSFET (Metal Oxide Semiconductor Field Effect Transistor) 734, a power diode 736, power MOSFETs 741, 742, 743, and 744, an igniter circuit 752, a igniter transformer 754, a lamp connector 768, PWM (Pulse Width Modulation) chips 772 and 773, an MCU (Micro Control Unit) 782, a control signal connector 792, and a photo coupler 794. The heat radiator 624 of the ballast unit 620 radiates heat generated by each electronic component of the power MOSFET 734, the power diode 736, and the power MOSFETs 741, 742, 743 and 744.

With reference back to FIG. 3, the power input section 710 of the ballast unit 620 is an electric circuit includes the power cord 712 and receives input power supplied from the outside of the ballast unit 620. In this embodiment, the power input section 710 receives DC power of 380 volt as the input power used for driving the discharge lamp 500 and receives DC power of 18 volt as input power used for driving the pulse width modulation control section 770 and the ballast control section 780.

The noise filter 720 of the ballast unit 620 is an EMI filter configured to suppress noise (Electro-Magnetic Interference; EMI) that is emitted from the down converter 730 to the outside of the ballast unit 620.

The down converter 730 of the ballast unit 620 is an electric circuit configured to include the inductor 732, the power MOSFET 734, and the power diode 736. The down converter 730 adjusts the power supplied to the inverter bridge 740 by stepping down the DC power input from the power input section 710. The pulse width modulation control section 770 of the ballast unit 620 is an electric circuit configured to include the PWM chips 772 and 773. The pulse width modulation control section 770 controls the down converter 730 by performing pulse width modulation based on a direction of the ballast control section 780.

The inverter bridge 740 of the ballast unit 620 is an electric circuit configured to include the power MOSFETs 741, 742, 743, and 744 and generates AC power from the DC power adjusted by the down converter 730. The igniter 750 of the ballast unit 620 is a start-up circuit configured to include the igniter circuit 752 and the igniter transformer 754. The igniter 750 applies a start-up pulse that is used for starting the discharge lamp 500. The lamp connection section 760 of the ballast unit 620 is an electric circuit configured to include the lamp connector 768. The lamp connection section 760 transmits the start-up pulse applied by the igniter 750 to the discharge lamp 500 and transmits the AC power generated by the inverter bridge 740 to the discharge lamp 500.

The control connection section 790 of the ballast unit 620 is an electric circuit configured to include the control signal connector 792 and the photo coupler 794. The control connection section 790 relays data that is exchanged between the ballast control section 780 and the driving control unit 610.

The ballast control section 780 of the ballast unit 620 is an electronic circuit configured to include the MCU 782. The ballast control section 780 controls sections of the pulse width modulation control section 770, the inverter bridge 740, and the igniter 750 based on a direction of the driving control unit 610. The ballast control section 780 includes a non-volatile memory 788, a start-up control portion 810, a history recording portion 820, a start-up suppressing portion 830, and an information output portion 840.

The non-volatile memory 788 of the ballast control section 780 is a memory device configured to store data to be writable and maintains data stored once without supplying power. In this embodiment, the non-volatile memory 788 is a flash memory configured to store data to be rewritable and is built in the MCU 782.

The start-up control portion 810 of the ballast control section 780 performs a start-up control process in which start-up pulses are consecutively generated by controlling the igniter 750. The start-up control process will be described later in detail.

The history recording portion 820 of the ballast control section 780 records the operation history of start-up pulses applied by the igniter 750 in the non-volatile memory 788. In this embodiment, the history recording portion 820 records in the non-volatile memory 788 the number of the start-up operations that is the number of times the start-up control processes are performed by the start-up control portion 810 as the operation history of the start-up pulses applied by the igniter 750.

The start-up suppressing portion 830 of the ballast control section 780 suppresses application of the start-up pulse that is applied by the igniter 750 based on the operation history recorded in the non-volatile memory 788. The information output portion 840 of the ballast control section 780 outputs various types of information to the driving control unit 610 through the control connection section 790.

In this embodiment, the functions of the start-up control portion 810, the history recording portion 820, the start-up suppressing portion 830, and the information output portion 840 of the ballast control section 780 are implemented by the operation the MCU 782 that is performed based on a program. However, in another embodiment, the functions may be implemented by the operation of the electronic circuit of the ballast control section 780 that is performed based on the physical circuit configuration thereof.

A4. Operation of Projector

Figure 5:
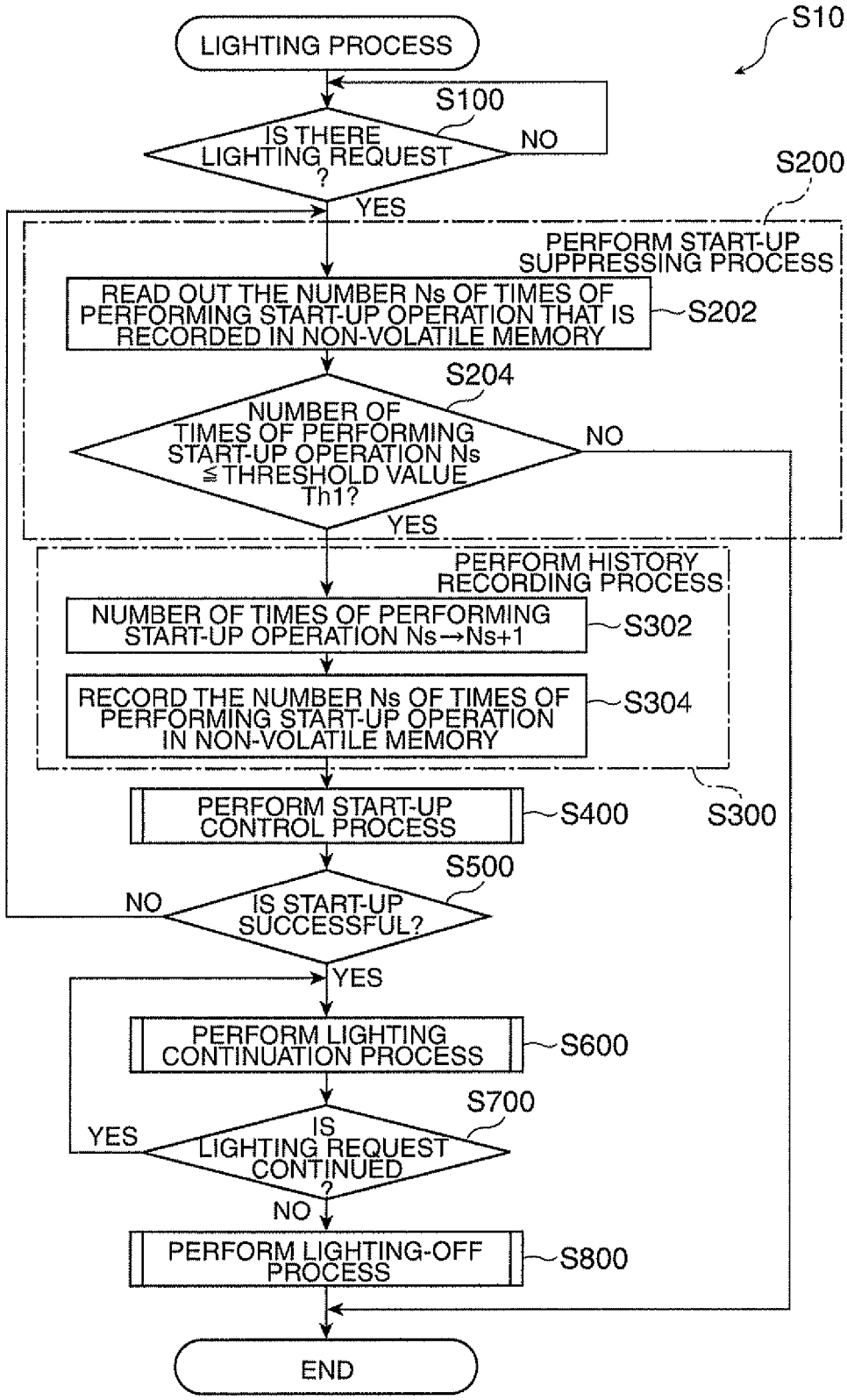
FIG. 5 is a flowchart showing a lighting process that is performed by a ballast control unit of a lamp driving device.

FIG. 5 is a flowchart showing a lighting process (Step S10) that is performed by the ballast control section 780 of the lamp driving device 600. The lighting process (Step S10) is a process in which the operation of the discharge lamp 500 is started based on a lighting request transmitted from the driving control unit 610, and the lighting of the discharge lamp 500 is maintained. In this embodiment, when the turn on the lamp driving device 600, the ballast control section 780 starts the lighting process (Step S10).

When the lighting process (Step S10) is started, the ballast control section 780 waits until a lighting request is received from the driving control unit 610 (Step S100). In this embodiment, a lighting request is continuously output from the driving control unit 610 to the ballast control section 780 during the lighting of the discharge lamp 500.

When receiving the lighting request from the driving control unit 610 (Step S100: "YES"), the ballast control section 780 performs a start-up suppressing process (Step S200) by being operated as the start-up suppressing portion 830. The start-up suppressing process (Step S200) is a process in which application of a start-up pulse that is performed by the igniter 750 is suppressed based on the operation history recorded in the non-volatile memory 788.

In the start-up suppressing process (Step S200), the ballast control section 780 reads out the number Ns of times of performing the start-up operations configured to indicate the accumulated number of times of performing a start-up control process (Step S400) to be described later from the non-volatile memory 788 as the operation history of the application of the start-up pulse that is performed by the igniter 750 (Step S202). Thereafter, the ballast control section 780 determines whether the number Ns of times of performing the start-up operations read out from the non-volatile memory 788 is equal to or less than a threshold value Th1 (Step S204). In this embodiment, the threshold value Th1 is set to one million. However, the threshold value Th1 may be changed to an arbitrary value in consideration with various factors such as the specifications of the ballast unit 620 and the use status of the discharge lamp 500.

When the number Ns of times of performing the start-up operations read out from the non-volatile memory 788 exceeds the threshold value Th1 (Step S204: "NO"), the ballast control section 780 completes the lighting process (Step S10). Accordingly, the application of a start-up pulse that is performed by the igniter 750 is suppressed.

On the other hand, when the number Ns of times of performing the start-up operations that is read out from the non-volatile memory 788 is equal to or less than the threshold value Th1 (Step S204: "YES"), the ballast control section 780 completes the start-up suppressing process (Step S200), and the process proceeds to a process for lighting the discharge lamp 500. In this embodiment, the ballast control section 780 operates as the history recording portion 820, whereby performing a history recording process (Step S300). The history recording process (Step S300) is a process of recording the operation history of the start-up pulses applied by the igniter 750 in the non-volatile memory 788. In the history recording process (Step S300), the ballast control section 780 adds one to the number Ns of times of performing the start-up operations that is read out from the non-volatile memory 788 (Step S302) and records the resultant number Ns of the start-up operations in the non-volatile memory 788 (Step S304).

After the history recording process (Step S300) is performed, the ballast control section 780 operates as the start-up control portion 810 whereby performing the start-up control process (Step S400). The start-up control process (Step S400) is a process of consecutively generating start-up pulses by controlling the igniter 750.

In the start-up control process (Step S400), the ballast control section 780 generates a start-up pulse by accumulating electric charges in the igniter circuit 752 of the igniter 750 and then discharging the electric charges accumulated in the igniter circuit 752 to the igniter transformer 754. In this embodiment, the ballast control section 780 performs an operation of consecutively generating start-up pulses with a cycle of about 40 Hz for about two seconds by performing inversion driving for the inverter bridge 740 at the speed of about 40 Hz in the state in which DC power of 380 volt that is approximately the same as the value of a voltage input from the down converter 730. In other words, the start-up control portion 810 performs the start-up control process (Step S400) as a series of sequence control operations that consecutively generates about 80 start-up pulses in about two seconds.

In the start-up control process (Step S400), when the operation of the discharge lamp 500 is not started (Step S500: "NO"), the ballast control section 780 repeatedly performs the process starting from the start-up suppressing process (Step S200). In this embodiment, the ballast control section 780 performs a succeeding start-up control process (Step S400) after about 30 seconds elapse from the previous start-up control process (Step S400).

On the other hand, when the operation of the discharge lamp 500 is started (Step S500: "YES") in the start-up control process (Step S400), the ballast control section 780 performs a lighting continuation process (Step S600) for continuing to light the discharge lamp 500 during a period in which the lighting request is continuously output from the driving control unit 610 (Step S700: "YES"). When the lighting request from the driving control unit 610 discontinues (Step S700: "NO"), the ballast control section 780 completes the lighting continuation process (Step S600). Then, the ballast control section 780 performs a light-off process (Step S800) for lighting off the discharge lamp 500 and then completes the lighting process (Step S10).

A5. Advantages

According to the above-described lamp driving device 600, the operating life of the lamp driving device 600 can be managed based on the number Ns of times start-up operations are performed which indicates the operation history of the igniter 750 that is stored in the non-volatile memory 788. In addition, the application of a start-up pulse that is performed by the igniter 750 is suppressed (Step S204) based on the number Ns of times start-up operations are performed that is stored in the non-volatile memory 788, and accordingly, the driving of the discharge lamp 500 by using the lamp driving device 600 configured to exceed the assumed operating time can be prevented. In addition, the number Ns of times start-up operations are performed in the start-up control process (Step S400) is stored in the non-volatile memory 788 as the operation history. Accordingly, compared to a case where information on each generated start-pulse is stored, the operation history can be managed in the non-volatile memory 788 in a simpler manner. In addition, the start-up suppressing process (Step S200) is performed prior to the start-up control process (Step S400), and accordingly, generation of a start-up pulse by using the lamp driving device 600 configured to exceed the assumed operating life can be avoided in advance. The non-volatile memory 788 is an electronic component that is mounted on the printed board 622 on which the igniter circuit 752 and the igniter transformer 754 configuring the igniter 750 are mounted. Accordingly, the operating life of the lamp driving device 600 can be managed for each printed board 622 that is influenced by deterioration of insulation due to start-up pulses.

B. First Modified Example

A lamp driving device 600 according to a first modified example is the same as that according to the above-described embodiment except that the number of the generated start-up pluses is recorded in the non-volatile memory 788 as the operation history.

Figure 6:
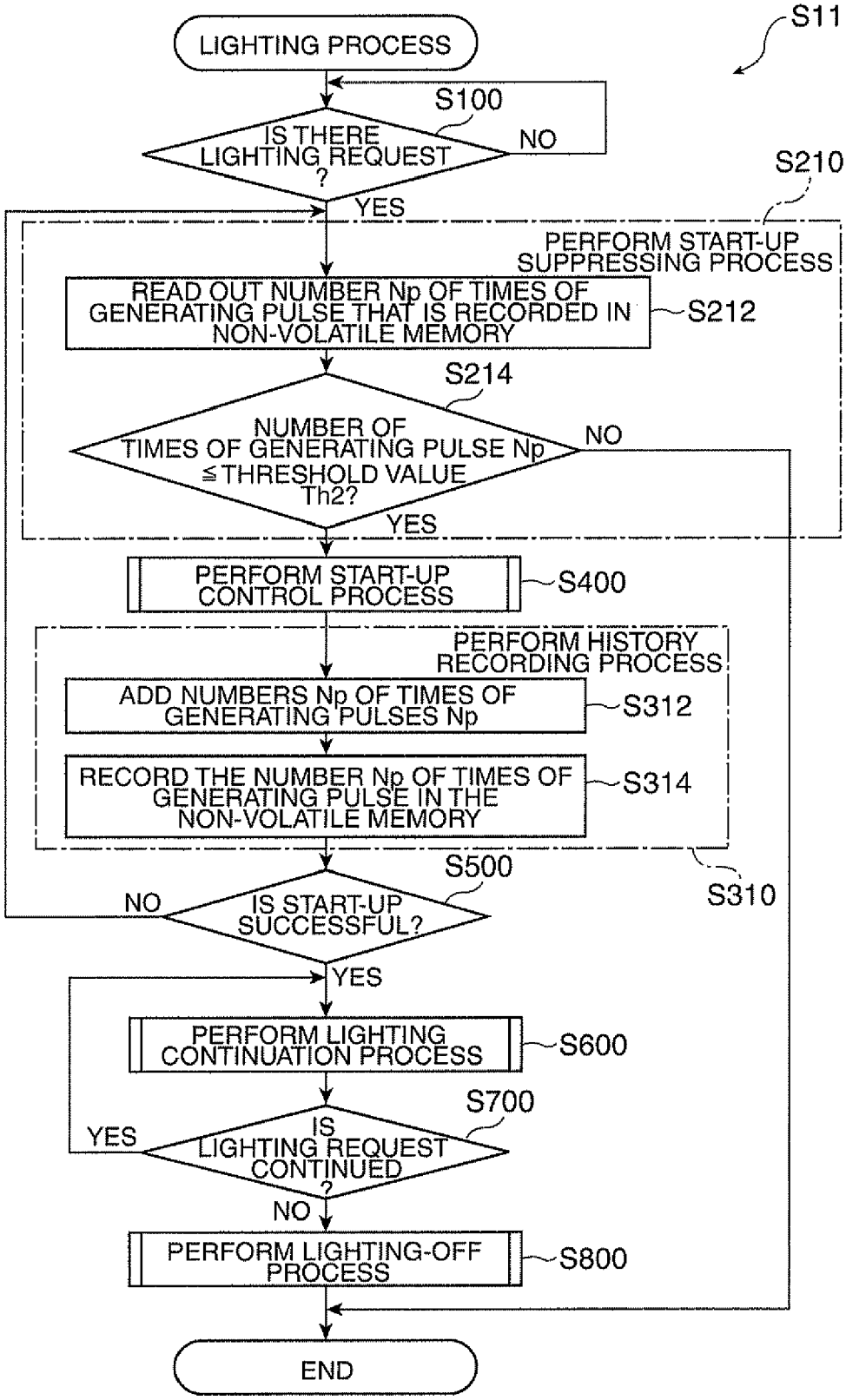
FIG. 6 is a flowchart showing a lighting process that is performed by a ballast control unit of a lamp driving device according to a first modified example.

FIG. 6 is a flowchart representing a lighting process (Step S11) that is performed by the ballast control section 780 of the lamp driving device 600 according to the first modified example. The lighting process (Step S11) is a process of starting the operation of the discharge lamp 500 based on the lighting request from the driving control unit 610 and maintaining the lighting of the discharge lamp 500. In this modified example, when the turn on the lamp driving device 600, the ballast control section 780 starts the lighting process (Step S11).

When receiving the lighting request from the driving control unit 610 (Step S100: "YES"), the ballast control section 780 performs a start-up suppressing process (Step S210) by being operated as the start-up suppressing portion 830. The start-up suppressing process (Step S210) is a process in which application of a start-up pulse that is performed by the igniter 750 is suppressed based on the operation history recorded in the non-volatile memory 788.

In the start-up suppressing process (Step S210), the ballast control section 780 reads out the number Np of generated pulses configured to indicate the accumulated number generated start-up pulses in the start-up control process (Step S400), to be described later, from the non-volatile memory 788 as the operation history of the application of the start-up pulse that is performed by the igniter 750 (Step S212). Thereafter, the ballast control section 780 determines whether the number Np of generated pulses read out from the non-volatile memory 788 is equal to or less than a threshold value Th2 (Step S214). In this modified example, the threshold value Th2 is set to ten million. However, the threshold value Th2 may be changed to an arbitrary value in consideration with various factors such as the specifications of the ballast unit 620 and the use status of the discharge lamp 500.

When the number Np of times the pulses are generated which is read out from the non-volatile memory 788 exceeds the threshold value Th2 (Step S214: "NO"), the ballast control section 780 completes the lighting process (Step S11). Accordingly, the application of a start-up pulse that is performed by the igniter 750 is suppressed.

On the other hand, when the number Np of times the pulses are generated which is read out from the non-volatile memory 788 is equal to or less than the threshold value Th2 (Step S214: "YES"), the ballast control section 780 completes the start-up suppressing process (Step S210) and performs a start-up control process (Step S400). The start-up control process (Step S400) according to the first modified example is the same as that according to the above-described embodiment.

After the start-up control process (Step S400) is performed, the ballast control section 780 operates as the history recording portion 820, whereby performing a history recording process (Step S310). The history recording process (Step S310) is a process of recording the operation history of the application of a start-up pulse that is performed by the igniter 750 in the non-volatile memory 788. In the history recording process (Step S310), the ballast control section 780 adds the number of times the start-up pulses are generated in the previous start-up control process (Step S400) to the number Np of times the pulses are generated which is read out from the non-volatile memory 788 (Step S312) and stores the resultant number Np of times the pulses are generated in the non-volatile memory 788 (Step S314).

After the history recording process (Step S310) is performed, the ballast control section 780 repeatedly performs the process started from the start-up suppressing process (Step S210) when the operation of the discharge lamp 500 is not started in the start-up control process (Step S400) (Step S500: "NO").

On the other hand, when the operation of the discharge lamp 500 is started (Step S500: "YES") in the start-up control process (Step S400) after the history recording process (Step S310), the ballast control section 780 performs the lighting continuation process (Step S600) as in the above-described embodiment.

According to the above-described lamp driving device 600, the operating life of the lamp driving device 600 can be managed based on the number Np of times the pulses are generated which indicates the operation history of the igniter 750 that is stored in the non-volatile memory 788. In addition, the application of a start-up pulse that is performed by the igniter 750 is suppressed based on the number Np of times the pulses are generated which is stored in the non-volatile memory 788 (Step S214), and accordingly, the driving of the discharge lamp 500 by using the lamp driving device 600 configured to exceed the assumed operating time can be prevented. In addition, the number Np of times the start-up pulses are generated, which causes the deterioration of insulation, is managed as the operation history, and accordingly, the state of deterioration of insulation of the lamp driving device 600 can be determined more accurately. In addition, the start-up suppressing process (Step S210) is performed prior to the start-up control process (Step S400), and accordingly, generation of a start-up pulse by using the lamp driving device 600 configured to exceed the assumed operating life can be avoided in advance.

C. Other Embodiments

As above, the embodiments of the invention have been described. However, the invention is not limited at all to the above-described embodiments and may be changed in various forms within the scope not departing from the basic concept of the invention.

For example, the ballast control section 780 may be configured to output the information such as the number Ns of times start-up operations are performed or the number Np of times the pulses are generated on the basis of the operation history recorded in the non-volatile memory 788 to the outside of the lamp driving device 600 through the control connection section 790 by operating as the information output portion 840. In such a case, display of usability or non-usability or display of the operating life may be performed based on the information output to the outside of the lamp driving device 600 by using a display or a lamp (not shown) that is disposed in the light source device 20 or the projector 10. According to the above-described embodiments, the operating life of the lamp driving device 600 can be managed outside the lamp driving device 600 based on the operation history that is stored in the non-volatile memory 788.

The present application claims priority from Japanese Patent Application No. 2009-032588 filed on Feb. 16, 2009, which is hereby incorporated by reference in its entirety.

What is claimed is:

1. A lamp driving device that drives a discharge lamp, comprising:

a start-up circuit configured to apply a high voltage for start-up for starting an operation of the discharge lamp;

a non-volatile memory configured to store data therein; and a history recording unit configured to record, in the non-volatile memory, an operating life history of the start-up circuit applying the high voltage for start-up, wherein the operating life history continues to be stored after the discharge lamp is successfully started.

2. The lamp driving device according to claim 1, further comprising:

a start-up suppressing unit configured to suppress the applying of the high voltage for start-up that is performed by the start-up circuit based on the operating life history recorded in the non-volatile memory.

3. The lamp driving device according to claim 2, further comprising:

a start-up control unit configured to perform a start-up control process of consecutively generating the high voltage for start-up by controlling the start-up circuit, wherein:

the history recording unit records the number of times the start-up operations are performed that is the number of times of performing the start-up control process in the non-volatile memory as the operation history, and the start-up suppressing unit suppress the applying of the high voltage for start-up that is performed by the start-up circuit when the accumulated number of times, which is acquired by accumulating the number of times the start-up operation has been performed, recorded in the non-volatile memory exceeds a reference threshold value.

4. The lamp driving device according to claim 2, wherein:

the history recording unit records the number of times of generating pulses, which is the number of times the high voltage for start-up is generated, in the non-volatile memory as the operating life history, and the start-up suppressing unit suppresses the applying of the high voltage for start-up that is performed by the start-up circuit when the accumulated number of times, which is acquired by accumulating the number of times the pulse is generated, recorded in the non-volatile memory exceeds a reference threshold value.

5. The lamp driving device according to claim 2, wherein:

the start-up suppressing unit suppresses the applying of the high voltage for start-up performed by the start-up circuit before the start-up circuit performs the start-up process and after turning on the lamp driving device, wherein the start-up suppressing unit suppresses applying the high voltage for start-up based on the operating life history recorded in the non-volatile memory.

6. The lamp driving device according to claim 1, wherein:

the non-volatile memory is an electronic component that is mounted on a printed board on which electronic components configuring the start-up circuit are mounted.

7. The lamp driving device according to claim 1, further comprising:

an information output unit configured to output information on the basis of the operating life history recorded in the non-volatile memory to the outside of the lamp driving device.

8. A light source device configured to emit light, the light source device comprising:

a discharge lamp configured to emit light by electric discharge between electrodes;

a start-up circuit configured to apply a high voltage for start-up for starting an operation of the discharge lamp;

a non-volatile memory configured to store data therein; and a history recording unit configured to record, in the non-volatile memory, the operating life history of the start-up circuit applying the high voltage for start-up, wherein the operating life history continues to be stored after the discharge lamp is successfully started.

9. A projector that projects a video, the projector comprising:

a discharge lamp configured to emit light by electric discharge between electrodes, as a light source of projection light representing the video;

a start-up circuit configured to apply a high voltage for start-up for starting an operation of the discharge lamp;

a non-volatile memory configured to store data therein; and a history recording unit configured to record, in the non-volatile memory, an operating life history of the start-up circuit applying the high voltage for start-up, wherein the operating life history continues to be stored after the discharge lamp is successfully started.

10. The projector according to claim 9, the start-up suppressing unit configured to suppress the applying of the high voltage for start-up that is performed by the start-up circuit based on the operating life history recorded in the non-volatile memory.

11. The projector according to claim 10, the start-up control unit configured to perform a start-up control process of consecutively generating the high voltage for start-up by controlling the start-up circuit, wherein:

the history recording unit records the number of times the start-up operations are performed that is the number of times of performing the start-up control process in the non-volatile memory as the operating life history, and the start-up suppressing unit suppress the applying of the high voltage for start-up that is performed by the start-up circuit when the accumulated number of times, which is acquired by accumulating the number of times the start-up operation has been performed, recorded in the non-volatile memory exceeds a reference threshold value.

12. The projector according to claim 10, the history recording unit records the number of times of generating pulses, which is the number of times the high voltage for start-up are generated, in the non-volatile memory as the operating life history, and the start-up suppressing unit suppresses the applying of the high voltage for start-up that is performed by the start-up circuit when the accumulated number of times, which is acquired by accumulating the number of times the pulse is generated, recorded in the non-volatile memory exceeds a reference threshold value.

13. The projector according to claim 10, the start-up suppressing unit suppresses the applying of the high voltage for start-up performed by the start-up circuit before the start-up circuit performs the start-up process and after turning on the lamp driving device, wherein the start-up suppressing unit suppresses applying the high voltage for start-up based on the operating life history recorded in the non-volatile memory.

14. The projector according to claim 9, the non-volatile memory is an electronic component that is mounted on a printed board on which electronic components configuring the start-up circuit are mounted.

15. The projector according to claim 9, the information output unit configured to output information on the basis of the operating life history recorded in the non-volatile memory to the outside of the lamp driving device.

16. A driving method for driving a discharge lamp by using a lamp driving device having a start-up circuit configured to apply a high voltage for start-up used for starting an operation of the discharge lamp, the method comprising steps of:

recording an operating life history of the start-up circuit applying the high voltage for start-up, by a computer included in the lamp driving device to a non-volatile memory, and continuing to store the operating life history in the non-volatile memory after the discharge lamp is successfully started.

* * * * *